US010905254B2

(12) United States Patent
Gutman

(10) Patent No.: US 10,905,254 B2
(45) Date of Patent: Feb. 2, 2021

(54) CHILD ENCLOSURE WITH CAMERA SUPPORT

(71) Applicant: Grand Brand LLC, Spring Valley, NY (US)

(72) Inventor: Boruch Gutman, Monsey, NY (US)

(73) Assignee: Grand Brand, LLC, Spring Valley, NY (US)

( * ) Notice: Subject to any disclaimer, the term of this patent is extended or adjusted under 35 U.S.C. 154(b) by 9 days.

(21) Appl. No.: 16/449,975

(22) Filed: Jun. 24, 2019

(65) Prior Publication Data

US 2020/0069075 A1 Mar. 5, 2020

Related U.S. Application Data

(63) Continuation-in-part of application No. 29/692,329, filed on May 24, 2019, now Pat. No. Des. 892,528.

(60) Provisional application No. 62/727,084, filed on Sep. 5, 2018.

(51) Int. Cl.

| | |
|---|---|
| ***A47C 29/00*** | (2006.01) |
| ***A47D 13/06*** | (2006.01) |
| ***G08B 21/02*** | (2006.01) |
| *A47D 7/00* | (2006.01) |

(52) U.S. Cl.

CPC ..... *A47D 13/066* (2013.01); *G08B 21/0205* (2013.01); *G08B 21/0291* (2013.01); *A47D 7/00* (2013.01)

(58) Field of Classification Search

CPC ..... A47D 7/00; A47D 7/002; A47D 7/005; A47C 29/00; A47C 29/003; A47C 29/006

See application file for complete search history.

(56) References Cited

U.S. PATENT DOCUMENTS

| | | | | | |
|---|---|---|---|---|---|
| 4,862,534 | A * | 9/1989 | Gomez-Marcial | A47C 29/006 | 5/97 |
| 4,901,481 | A * | 2/1990 | Seeley, Jr. | E04H 15/20 | 52/2.15 |
| 4,945,584 | A * | 8/1990 | LaMantia | A47C 29/003 | 135/127 |
| 5,078,096 | A * | 1/1992 | Bishop | A01K 1/0254 | 119/497 |
| 5,517,707 | A * | 5/1996 | LaMantia | A47C 29/003 | 135/96 |
| 5,881,678 | A * | 3/1999 | Morley | A01K 1/0236 | 119/496 |
| 6,067,676 | A * | 5/2000 | Carnahan | A47D 13/06 | 135/116 |
| 6,109,280 | A * | 8/2000 | Custer | A47C 29/006 | 135/116 |
| 6,109,282 | A * | 8/2000 | Yoon | E04H 15/40 | 135/124 |
| 6,263,894 | B1 * | 7/2001 | LaMantia | A47C 29/006 | 135/117 |
| 6,305,396 | B1 * | 10/2001 | Zheng | A63B 9/00 | 135/115 |

(Continued)

*Primary Examiner* — Peter M. Cuomo
*Assistant Examiner* — Ifeolu A Adeboyejo
(74) *Attorney, Agent, or Firm* — Myers Wolin, LLC

(57) ABSTRACT

A child enclosure is provided for use in a crib or playpen, and the enclosure has enclosure walls for locating adjacent crib walls to form an enclosed space. The child enclosure further comprises an enclosure cover covering the enclosed space and a window opening in the enclosure cover.

18 Claims, 10 Drawing Sheets

(56) References Cited

U.S. PATENT DOCUMENTS

| | | | | |
|---|---|---|---|---|
| 6,487,735 | B1 * | 12/2002 | Jacques, II | A47D 7/02 5/424 |
| 6,550,083 | B1 * | 4/2003 | LaMantia | A47C 29/003 135/96 |
| 8,944,010 | B2 * | 2/2015 | Willard | A01K 1/033 119/498 |
| 10,149,551 | B2 * | 12/2018 | Long | A47D 7/04 |
| 10,208,499 | B2 * | 2/2019 | Lovell | A47C 29/003 |
| 2004/0065361 | A1 * | 4/2004 | Pratt | E04H 15/324 135/148 |
| 2005/0081903 | A1 * | 4/2005 | Wang | E04H 15/40 135/126 |
| 2006/0168722 | A1 * | 8/2006 | Ramirez | A47D 13/066 5/93.1 |
| 2013/0291918 | A1 * | 11/2013 | Lovell | A47C 29/003 135/151 |
| 2018/0042397 | A1 * | 2/2018 | Brereton | A47C 29/003 |
| 2018/0055241 | A1 * | 3/2018 | Mallory | E04H 15/324 |

* cited by examiner

CHILD ENCLOSURE WITH CAMERA SUPPORT

CROSS REFERENCE TO RELATED APPLICATIONS

This application is a Continuation in Part of U.S. Design patent application No. 29/692,329, filed May 24, 2019, and claims the benefit of U.S. Provisional Patent Application No. 62/727,084, filed Sep. 5, 2018, the contents of each of which are incorporated by reference herein.

FIELD OF THE INVENTION

This invention relates to child enclosures for use in cribs and playpens.

BACKGROUND

Cribs are often used for retaining children without direct adult supervision. Such cribs are used to limit the amount of freedom of movement provided to such children, thereby minimizing the amount of adult supervision required. In order to ease the provision of adult supervision still necessary, adults often use cameras, in the form of baby monitors or smartphones, to view children resting in cribs. Such cameras may record and/or transmit images or video constantly, or they may be triggered to record and/or transmit video upon detecting movement or sound from a child.

Because many adults supervising children prefer not to place items in cribs with children for safety reasons, such cameras are often placed outside of the crib and aimed towards the interior space of the crib.

A typical crib is constructed of crib walls on four sides forming a rectangle and a crib base covered by a crib mattress. The crib walls are often slatted or otherwise provided with openings. Further cribs typically have open tops. As such, children in cribs may be able to extend limbs through slats and get stuck in uncomfortable positions. Further, older children may be able to climb out of a crib, thereby preventing the crib from limiting the child's freedom of movement.

Enclosures exist for covering cribs or fully enclosing children within a crib. Such enclosures may prevent children from extending limbs through crib slats or climbing out of such a crib, but such enclosures also obstruct viewing of children within cribs. This is particularly problematic for adults in a different room than the crib using a camera to monitor a child in the crib. This issue is further exacerbated for parents who do not wish to place anything, such as a camera, inside the crib space with a child, as any placement of a camera outside of the crib will be obstructed by the material forming the enclosure.

While this disclosure is written in terms of a crib, similar issues exist in playpens, where children may be left inside an enclosed area to sleep or play, and the term crib is used throughout to refer to both cribs and playpens.

There is therefore a need for a child enclosure that does not interfere with or obstruct the use of a camera for monitoring a child.

SUMMARY

A child enclosure is provided for use in a crib or playpen, and the enclosure has enclosure walls for locating adjacent crib walls to form an enclosed space. The child enclosure further comprises an enclosure cover covering the enclosed space and a window opening in the enclosure cover.

The enclosure cover may extend upwards from the enclosure walls and form a dome over the enclosed space, and the walls of the enclosure may extend above the adjacent crib walls.

In some embodiments, the enclosure cover extends substantially horizontally across the enclosed space.

The window opening may comprise a retainer for retaining a camera device. The retainer may be, for example, a strap for retaining a smartphone device such that a camera lens faces through the window opening.

In some embodiments, the window opening may be smaller than the smartphone device, or other camera device.

In some embodiments, the window opening may further comprise a clear window, such that the retainer retains the camera device against the clear window.

In some embodiments, the child enclosure further comprises a flap for covering the window opening, and the window opening may then be closable by covering it with the flap.

In some embodiments, the window opening may be located in the enclosure cover adjacent one of the walls. In other embodiments, the window opening may be spaced apart from each of the plurality of walls, and may be centered in the enclosure cover along either a length or width, or both, of the child enclosure.

The child enclosure may further comprise a camera located at the window opening, with such a camera being located at the window opening either permanently or removably.

In some embodiments, the viewing window is a linear window extending along a width of the enclosure cover.

In some embodiments, the enclosure may further comprise straps for binding at least one of the enclosure walls to an adjacent crib wall. Such straps may be Velcro straps, and may extend across a width of an enclosure wall and a corresponding width of the corresponding crib wall.

The child enclosure may further comprise a bottom, the bottom extending from a bottom edge of each of the enclosure walls and extending below a crib mattress.

In some embodiments, the enclosure walls are supported by the corresponding crib walls, and a crib mattress pushes the bottom edge of each enclosure wall against the corresponding crib walls. In such an embodiment, the bottom may be at least partially elastic, and it may not fully enclosure a space between the bottom edge of each enclosure wall, such that the bottom may be stretched around the crib mattress.

The child enclosure may further comprise a primary opening, for accessing an interior of the enclosure in a first enclosure wall, where the primary opening is closable by a panel larger than the window opening. The child enclosure may further comprise a secondary opening provided in a second enclosure wall opposite the first enclosure wall.

The primary opening may then extend to a boundary of the first enclosure wall along an upper portion of the first enclosure wall and side portions of the first enclosure wall, such that the primary opening forms the entirety of an upper segment of the first enclosure wall. The secondary opening may then not extend to a side portion of the secondary enclosure wall, such that the secondary opening is narrower than the primary opening.

DETAILED DESCRIPTION OF THE PREFERRED EMBODIMENTS

Figure 1A:
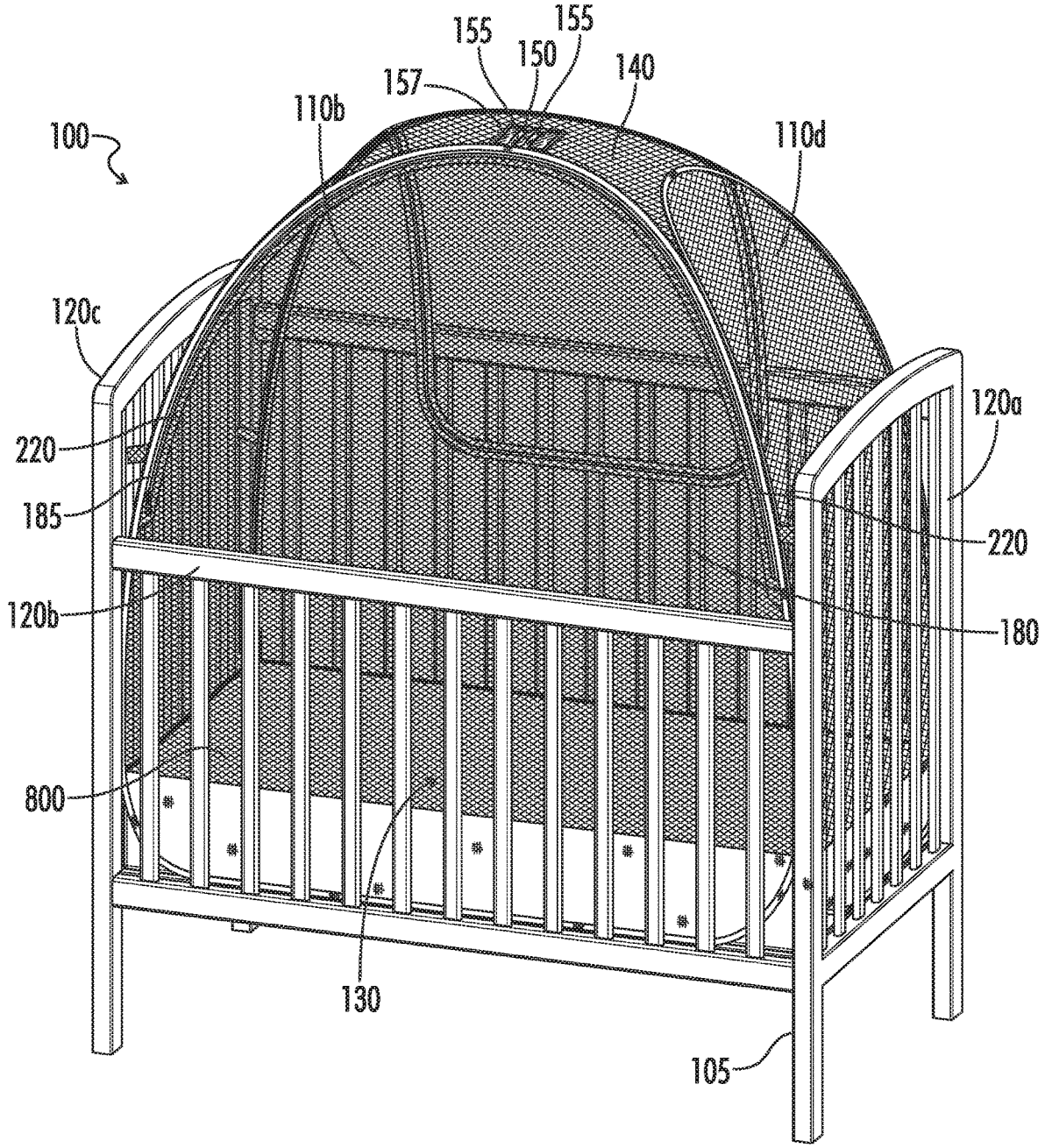
FIGS. 1A-1B show an embodiment of a child enclosure installed in a crib.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 1B:
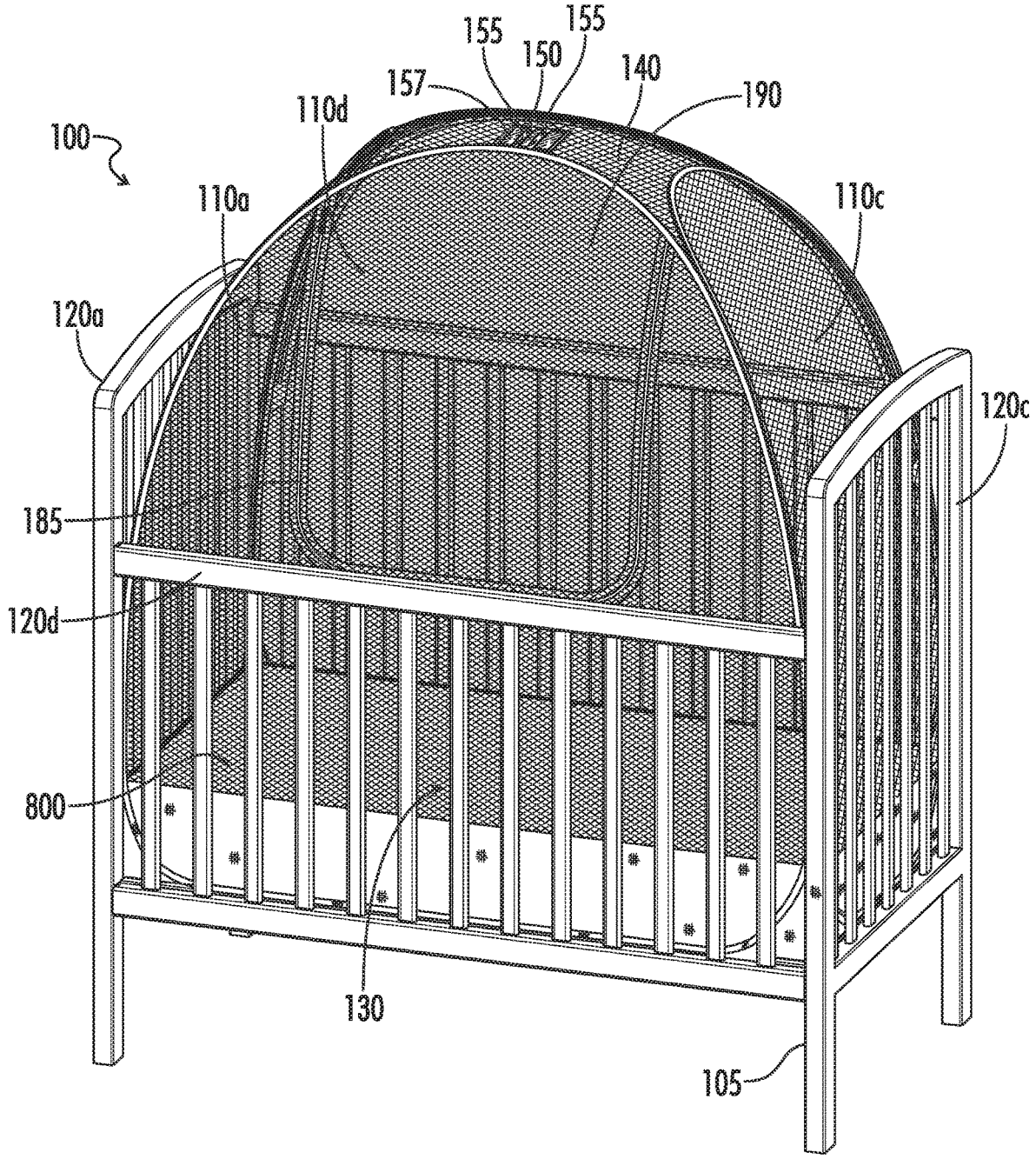

FIGS. 1A-1B show an embodiment of a child enclosure 100 installed in a crib 105. As shown, the child enclosure 100 comprises four walls 110*a-d*, each adjacent a corresponding wall 120*a-d* of the crib 105. The four walls together form an enclosed space 130 and an enclosure cover 140 covers the enclosure. A window opening 150 is formed in the enclosure cover 140.

As shown, the window opening 150 is formed as a square or rectangle opening, and it is substantially centered along both a length and width of the child enclosure 100. The window opening 150 is configured to retain a camera or smartphone (not shown) and is located such that a camera lens positioned at the window opening is provided with a wide view of the enclosed space 130. Accordingly, the window opening 150 may be spaced apart from each of the plurality of walls of the child enclosure 100.

While the embodiment is shown with a window opening 150 provided such that a user may apply their own camera or smartphone, other embodiments are provided with a camera integrated into and located at the opening.

In the embodiment shown, each of the enclosure walls 110*a-d* extend above the adjacent crib wall 120*a-d*, and the crib cover 140 then extends substantially horizontally across the enclosed space 130. In some alternative embodiments, the walls of the enclosure may stop at the top of the crib walls, in which case the crib cover may extend upwards from the top of the walls and form a dome over the enclosed space 130.

In addition to the window opening 150, a primary opening 180 may be provided for accessing an interior of the child enclosure 100. This may be a large opening for placing a child into the child enclosure 100, for example. Such a primary opening 180 may be provided with a flap for covering the opening and may be sealed using, for example, a zipper enclosure 185 or Velcro. In the embodiments shown, the primary opening 180 is shown in a wall 110*b* of the enclosure 100, but in alternative embodiments it may be provided in the enclosure cover 140. Further, the primary opening 180 is substantially larger than the window opening 150. In some embodiments, the window opening 150 may be located in the panel covering the primary opening 180, such that both may be located in the enclosure cover 140.

In the embodiment shown, the primary opening 180 is provided in a first enclosure wall 110*b*, and a secondary opening 190 may be provided in a second enclosure wall 110*d* opposite the first enclosure wall 110*b*. In the embodiment shown, the primary opening 180 extends to a boundary of the first enclosure wall 110*b* along an upper portion 210 of the first enclosure wall and side portions 220 of the first enclosure wall. Accordingly, the primary opening 180 forms the entirety of an upper segment of the first enclosure wall 110*b*. When the primary opening 180 is opened, the upper segment of the first enclosure wall 110*b* may then fold down, fully opening the corresponding side of the enclosure.

In such an embodiment, the secondary opening 190 does not extend to a side portion of the second enclosure wall 110*d*. Instead, the secondary opening 190 is narrower than the primary opening 180, and forms a shape approximately a rectangle.

Further, as shown, the primary opening may unzip across the top of the corresponding wall 110*b*, and may therefore fold downwards. In contrast, the secondary opening 190 may open, such as by unzipping a zipper, around the bottom of the approximately rectangular shape, and the secondary opening may have a cover that opens upwards and is similarly fixed to the corresponding wall 110*d* by a zipper 185. In this way, the primary opening 180 may be substantially larger than the secondary opening 190. Typically, the secondary opening 190 may be used to insert and remove a child from the enclosure 100, while the primary opening 180 may be used when a wider space may be necessary, such as for changing the mattress or sheets.

Figure 2A:
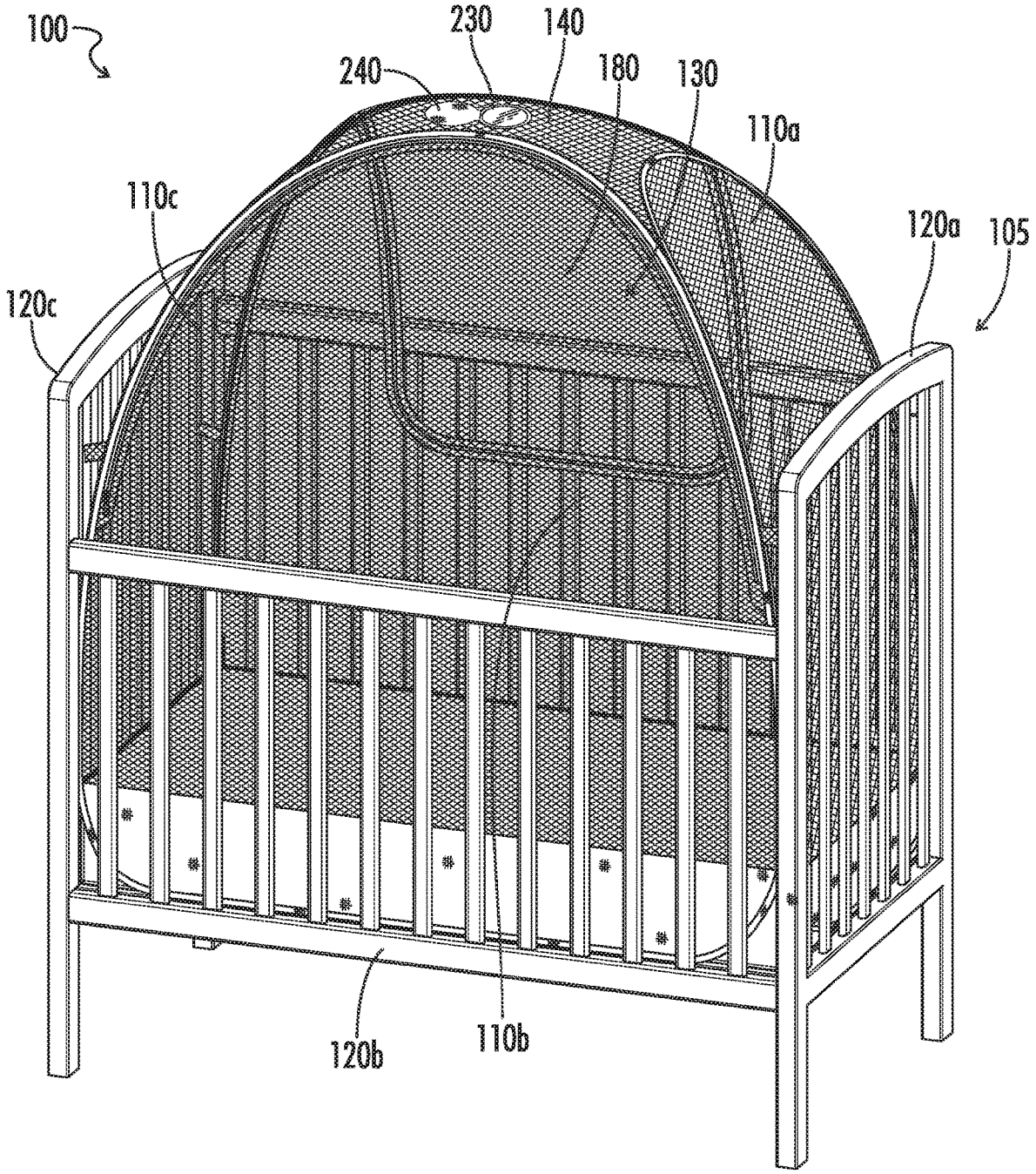
FIGS. 2A-2B show a second embodiment of a child enclosure installed in a crib.
Figure 2B:
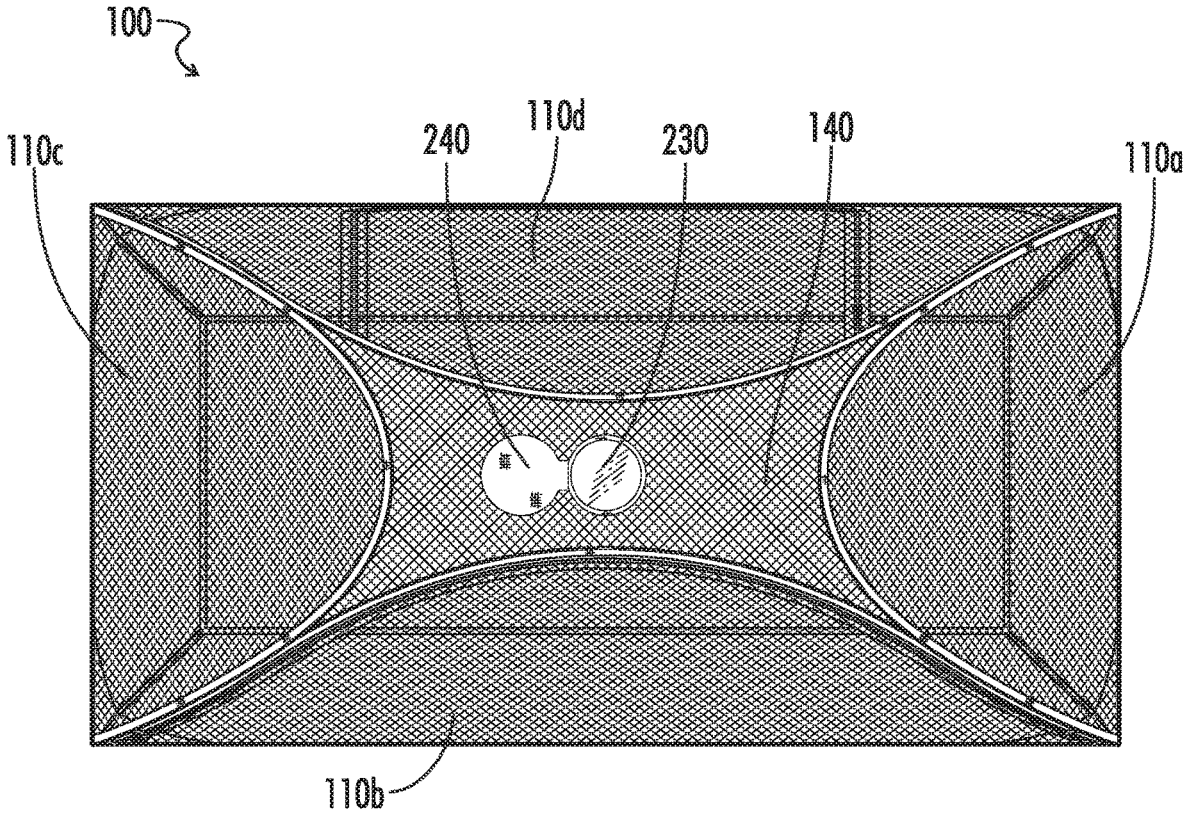

FIGS. 2A-2B is a second embodiment of a child enclosure 100 installed in a crib. The embodiment shown is similar to that of FIG. 1 in all respects other than the window opening 230 being provided as a circular opening. Further, as shown, the window opening 230 may be provided with a flap 240 for covering the opening.

Figure 3:
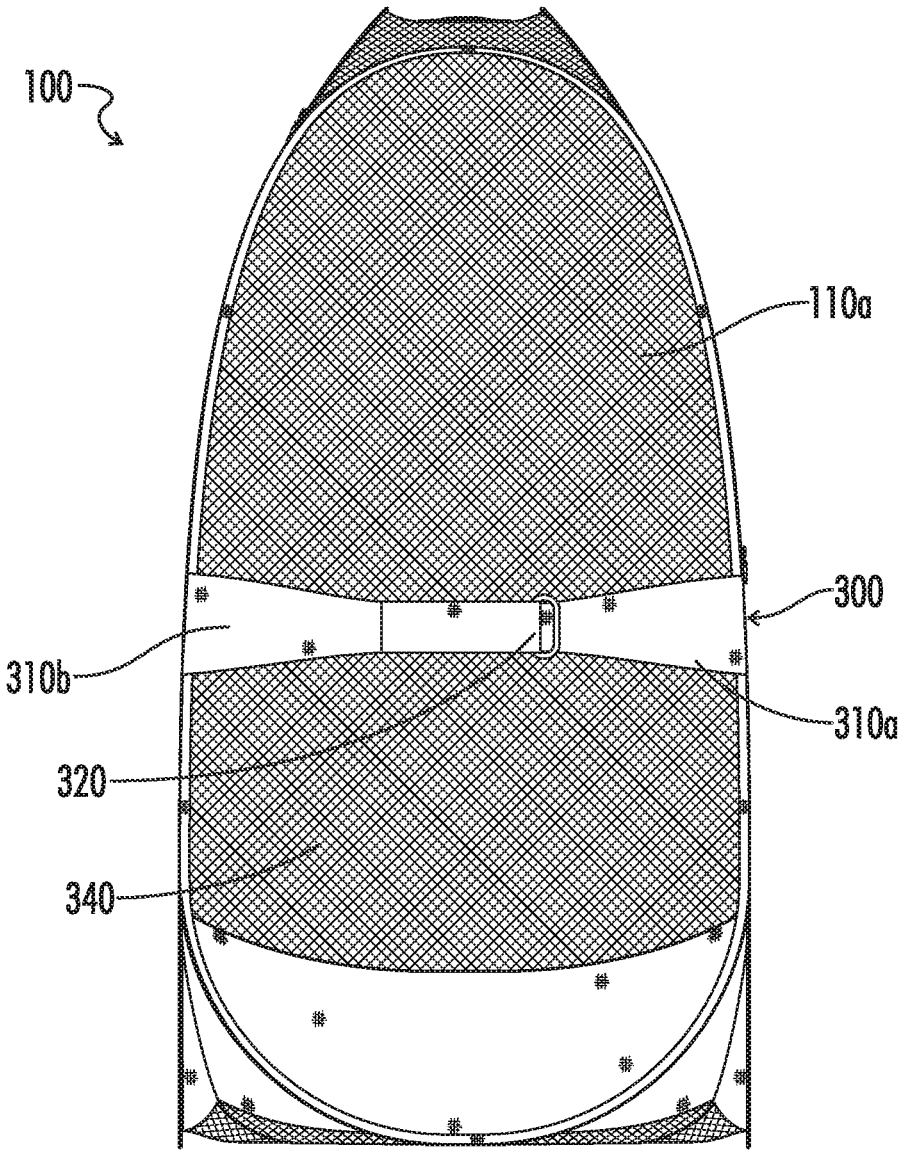
FIG. 3 is a side view of a child enclosure.

FIG. 3 is a side view of a child enclosure 100, such as that of FIG. 1. As shown, at least one child enclosure wall 110*a* may be provided with at least one strap 300 for binding the enclosure wall to a corresponding crib wall 120*a*. The straps 300 may comprise multiple strap segments 310*a, b*, and may further comprise a fixation element 320, such as a Velcro component, for fixing the strap segments to each other and encompassing the corresponding crib wall 120*a*. Such a strap 300 may thereby extend along an entire width 170 of the child enclosure 100.

While FIG. 3 provides a variation of the child enclosure 100 including the straps 300, it will be understood that a wide variety of fixation elements are contemplated. For example, FIG. 1 illustrates independent tie down elements at each of the four corners of the child enclosure 100. While these are shown cut off, each may be elongated, and each corner may have two elongated elements extending therefrom, such that each corner of the child enclosure 100 may be tied to the corresponding corner of the crib 105.

Where a Velcro strap is used, the strap may be wider at contact points with the enclosure wall 110*a*, and the strap may be narrower where the Velcro links the portions of the straps. Accordingly, the wider portion of the strap may be, for example, 5 inches wide, while the narrower side may be the same width as the Velcro being used. The straps may be made of a mesh material.

Figure 4:
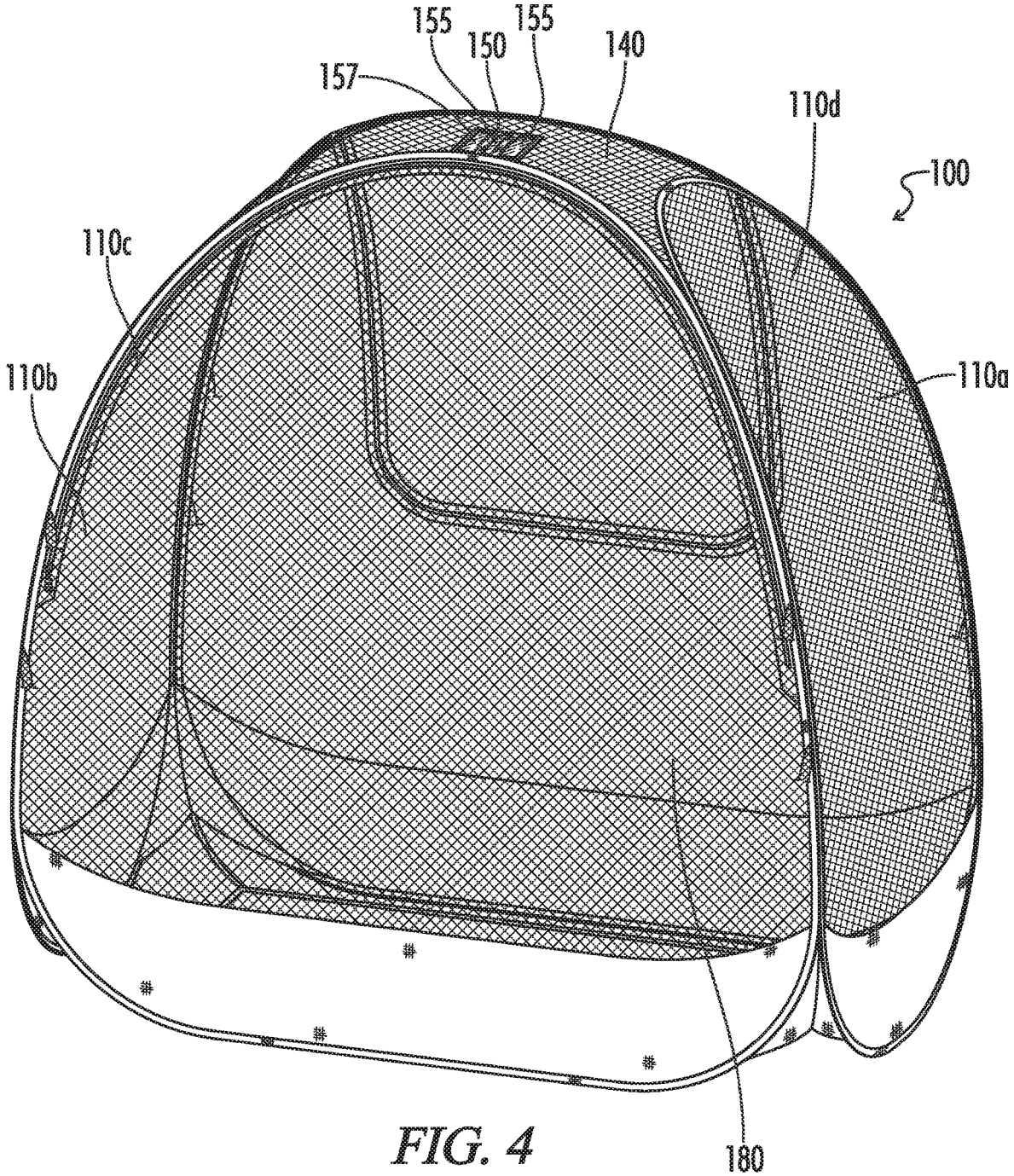
FIG. 4 is a top perspective view of the child enclosure of FIG. 1.
Figure 5A:
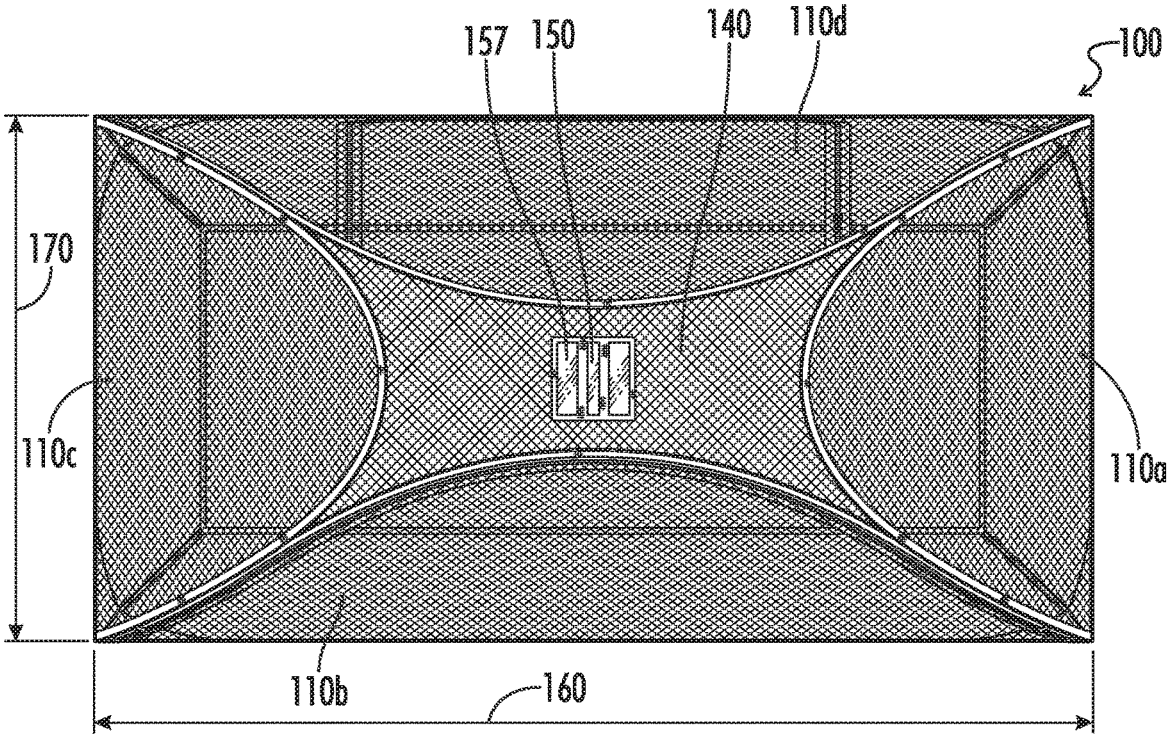
FIG. 5A is a top view of the child enclosure of FIG. 1.
Figure 5B:
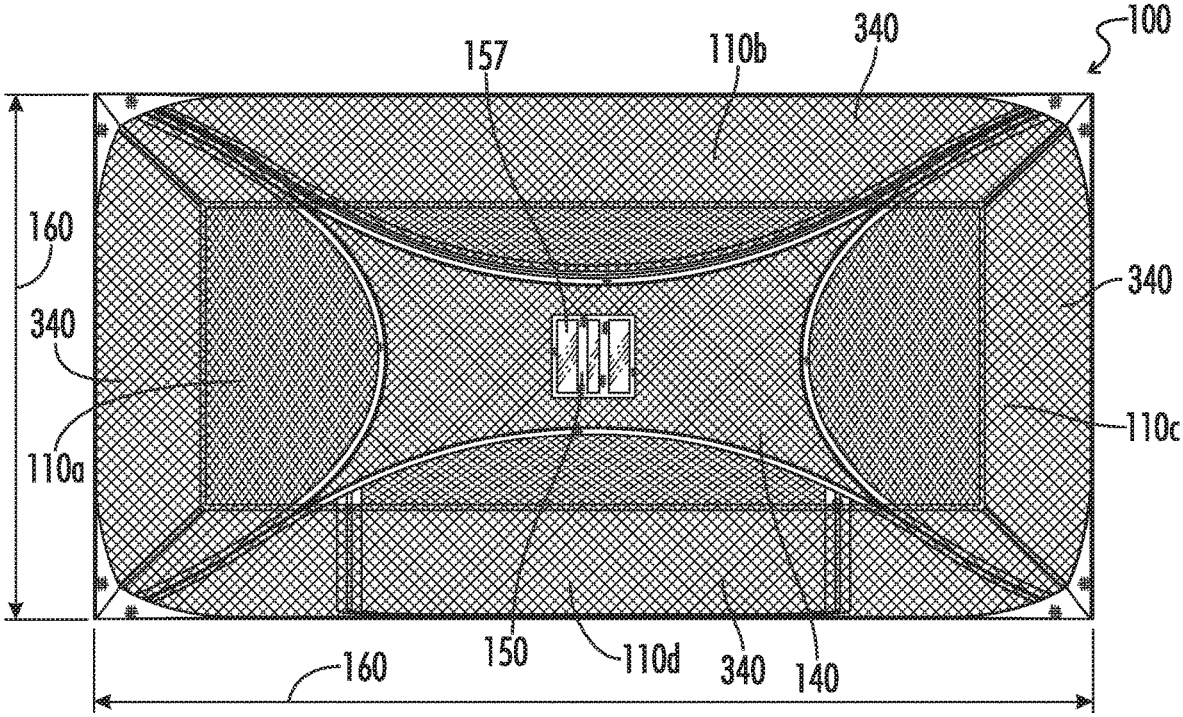
FIG. 5B is a bottom view of the child enclosure of FIG. 1.

FIG. 4 is a top perspective view of a child enclosure 100. FIG. 5A is a top view of the child enclosure 100 including a view of the window opening 150 in the enclosure cover 140, and FIG. 5B is a bottom view of the child enclosure.

The child enclosure 100 may further comprise a bottom 340, the bottom extending from a bottom edge of each of the child enclosure walls 110 and extending across a bottom of the enclosed space 130. When in use, the bottom 340 of the child enclosure 100 may be located below a crib mattress 800, as shown in FIG. 1. Accordingly, when installed, the crib mattress 800 may push the bottom edge of each enclosure wall 110 outwards against the corresponding crib wall 120.

As shown, the bottom 340 may not fully enclose the space between the walls 110, resulting in an opening. The bottom 340 may further be at least partially elastic such that it can be easily stretched around the corresponding crib mattress 800.

It will be noted that while the window opening 150 is shown and discussed as centered in the enclosure cover 140, in some embodiments, the window opening may be provided adjacent a wall 110*a* of the child enclosure 100, such that a border dividing the wall 110*b* and the enclosure cover 140 forms one boundary of the window opening.

Accordingly in the embodiment shown, the window opening 150 is formed as a square or rectangle opening, and it is substantially centered along both a length 160 and width 170 of the child enclosure 100. The window opening 150 is provided with a retainer for retaining a smartphone or camera, the retainer taking the form of multiple straps 155. When a smartphone, for example, is placed at the window opening and secured by the straps, it can be positioned such that a camera lens faces downwards into the enclosed space.

Further, as shown, the window opening 150 may comprise a clear window 157. As such, when a camera device is used with the window opening, the multiple straps 155 may retain and compress such a device against the clear window 157.

Figure 6:
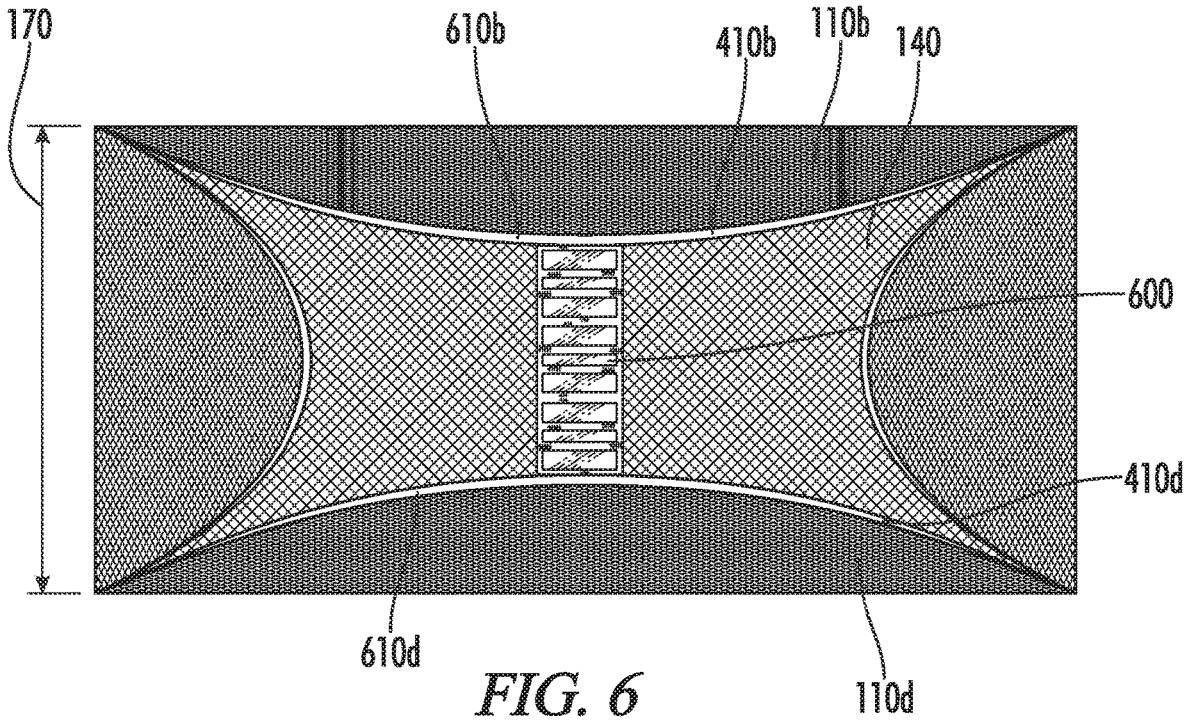
FIG. 6 is a schematic diagram of an alternative embodiment of a window opening in the crib cover of FIG. 4

FIG. 6 is a schematic diagram of an alternative embodiment of a window opening 600 in the crib cover 140 of FIG. 4. As shown, the window opening 600 may extend the entire width 170 of the enclosure 100 and may thereby extend from the boundary 610*b* between one wall 110*b* and the enclosure cover 140 to the boundary 610*d* between a second wall 110*d* and the enclosure cover.

Figure 7:
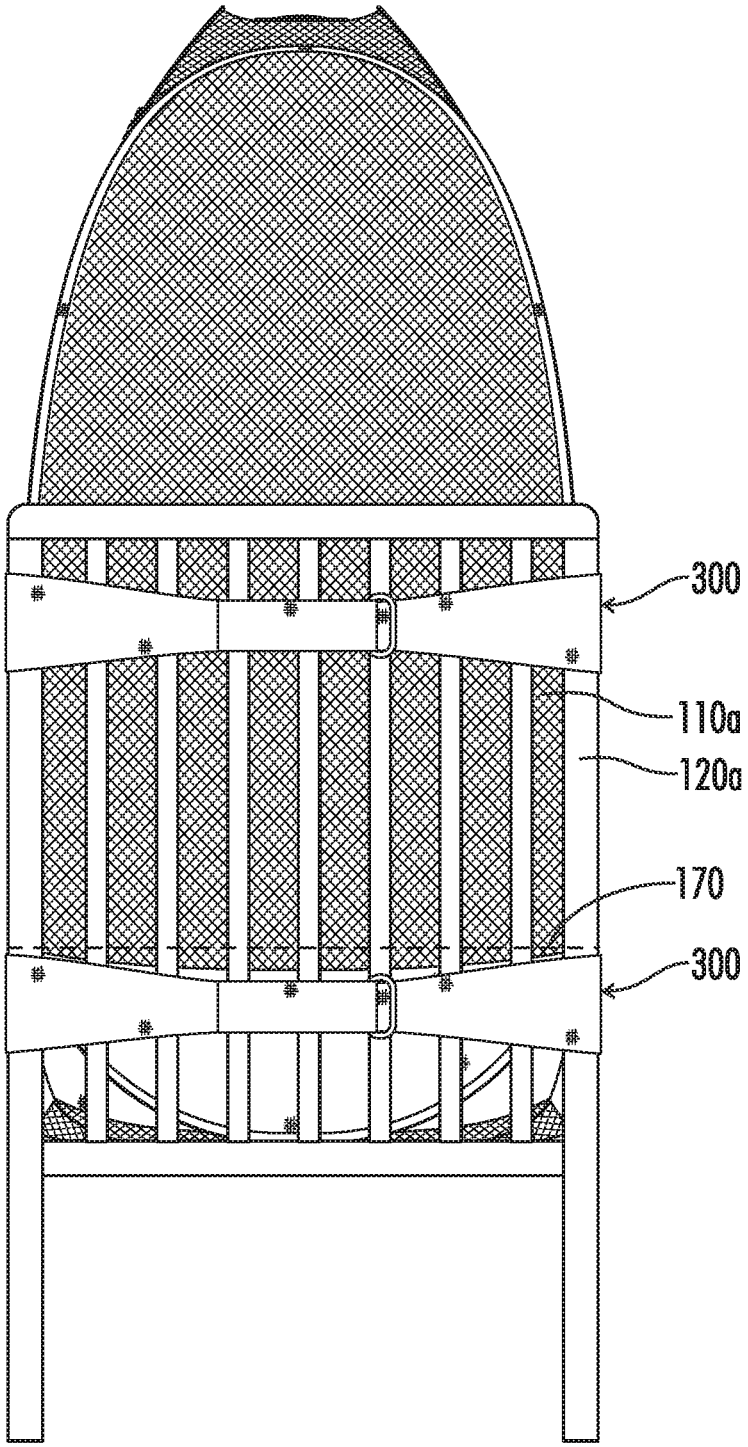
FIG. 7 is a side view of a fixation mechanism for fixing a child enclosure to a crib.

FIG. 7 is a side view of a fixation mechanism for fixing a child enclosure 100 to a crib 105. As shown, the crib enclosure 100 may be provided with multiple straps 300, thereby securing an enclosure wall 110*a* to a corresponding crib wall 120*a*.

Figure 8:
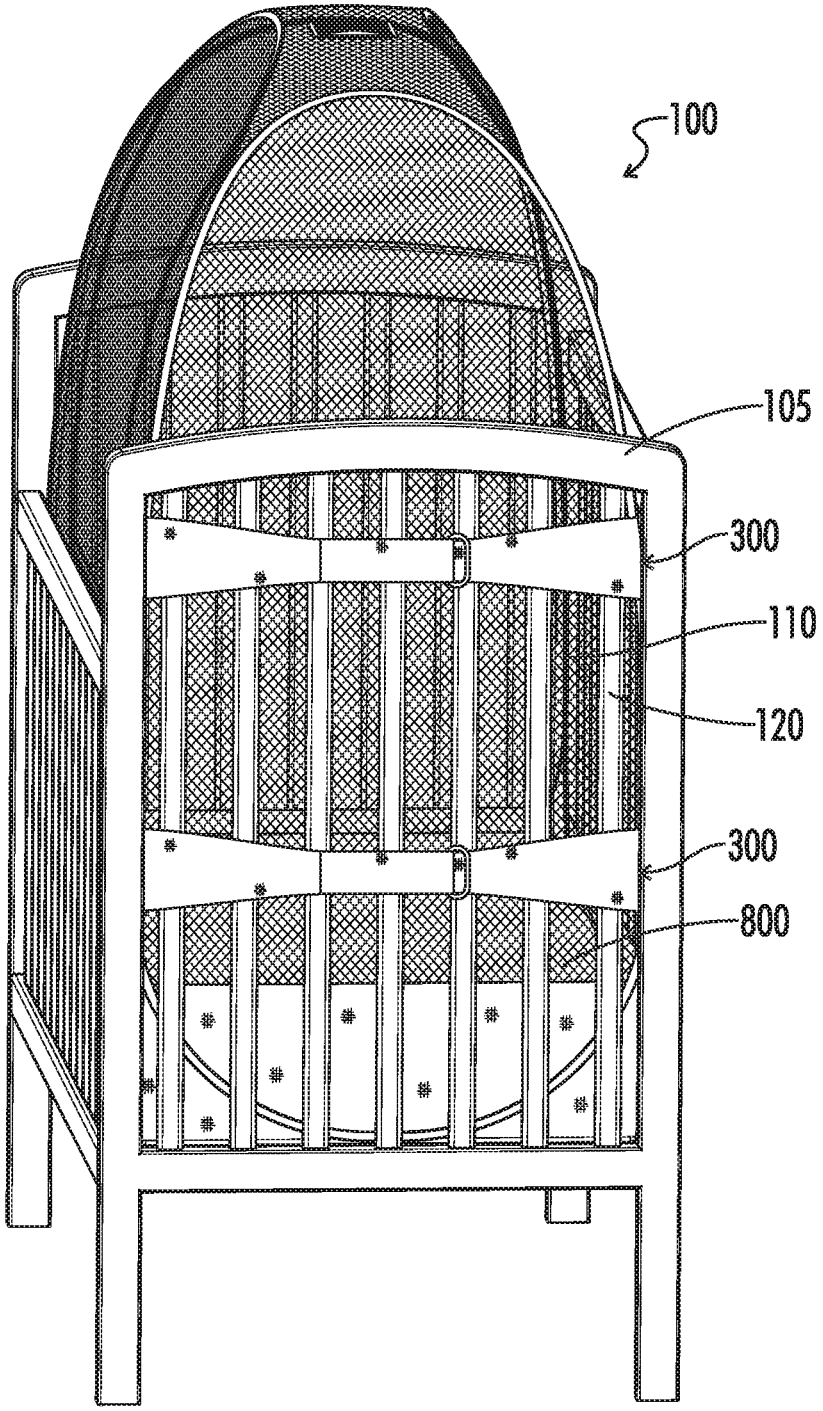
FIG. 8 is a side view a child enclosure fixed to a crib.

FIG. 8 is a side view a child enclosure 100 fixed to a crib 105. As shown, the crib enclosure is provided with a mattress 800 which pushes each enclosure wall 110 outwards against the corresponding crib wall 120.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A child enclosure for use in a crib comprising:

a plurality of enclosure walls for locating adjacent crib walls and forming an enclosed space;

an enclosure cover covering the enclosed space;

a window opening in the enclosure cover; and a retainer at the window opening for retaining a camera device, wherein the window opening and the retainer are both spaced apart from each of the plurality of enclosure walls.

2. The child enclosure of claim 1, wherein the enclosure cover extends upwards from the enclosure walls and forms a dome over the enclosed space.

3. The child enclosure of claim 1, wherein at least some of the plurality of enclosure walls extend above the adjacent crib walls and wherein the enclosure cover extends substantially horizontally across the enclosed space.

4. The child enclosure of claim 1, wherein the retainer is at least one strap for positioning a smartphone device such that a camera lens faces through the window opening.

5. The child enclosure of claim 4, wherein the window opening is smaller than the smartphone device.

6. The child enclosure of claim 1, the window opening further comprising a clear window, such that the retainer retains the camera device against the clear window.

7. The child enclosure of claim 1 further comprising a flap for covering the window opening, and wherein the window opening is closable by covering it with the flap.

8. The child enclosure of claim 1, wherein the window is centered in the enclosure cover along either a length or width of the child enclosure.

9. The child enclosure of claim 1 further comprising a camera located at the window opening.

10. The child enclosure of claim 1, wherein the window opening is a linear window extending along a width of the enclosure cover.

11. The child enclosure of claim 1, wherein the window opening is adjacent a boundary of the enclosure cover.

12. The child enclosure of claim 1 further comprising straps for binding at least one of the enclosure walls to an adjacent crib wall.

13. The child enclosure of claim 12, wherein the straps are Velcro straps and extend across a width of an enclosure wall and a corresponding width of the corresponding crib wall.

14. The child enclosure of claim 1 further comprising a bottom, the bottom extending from a bottom edge of each of the enclosure walls and extending below a crib mattress.

15. The child enclosure of claim 14, wherein the enclosure walls are supported by the corresponding crib walls, and wherein the crib mattress pushes the bottom edge of each enclosure wall against the corresponding crib walls.

16. The child enclosure of claim 15, wherein the bottom is at least partially elastic and does not fully enclose a space between the bottom edge of each enclosure wall, such that the bottom can be stretched around the crib mattress.

17. The child enclosure of claim 1 further comprising a primary opening for accessing an interior of the enclosure in an enclosure wall, wherein the primary opening is closable by a panel larger than the window opening.

18. The child enclosure of claim 17 wherein the primary opening is provided in a first enclosure wall and a secondary opening is provided in a second enclosure wall opposite the first enclosure wall, and wherein the primary opening extends to a boundary of the first enclosure wall along an upper portion of the first enclosure wall and side portions of the first enclosure wall, such that the primary opening forms the entirety of an upper segment of the first enclosure wall, and wherein the secondary opening does not extend to a side portion of the second enclosure wall, such that the secondary opening is narrower than the primary opening.

* * * * *